US005228582A

United States Patent [19]

Marshall et al.

[11] Patent Number: 5,228,582

[45] Date of Patent: Jul. 20, 1993

[54] HOLDER FOR SCREWS, BOLTS, NUTS AND WASHERS

[76] Inventors: J. C. Marshall; James C. Marshall, II, both of W. 1000 Silver Rd., Smeltersville, Id. 83868

[21] Appl. No.: 864,039

[22] Filed: Jul. 1, 1992

[51] Int. Cl.[5] ..... A47F 7/00

[52] U.S. Cl. ..... 211/163; 206/338; 211/13; 211/95

[58] Field of Search ..... 211/13, 95, 70, 163; 206/206, 338

[56] References Cited

U.S. PATENT DOCUMENTS

| | | | |
|---|---|---|---|
| 2,868,386 | 1/1959 | Seyforth | 211/95 |
| 2,941,669 | 6/1960 | Palay et al. | 211/163 X |
| 4,157,760 | 6/1979 | Wilson | 211/163 X |
| 4,480,755 | 11/1984 | Cartwright | 211/163 X |
| 5,054,627 | 10/1991 | Gregory | 211/13 X |

FOREIGN PATENT DOCUMENTS

| | | | |
|---|---|---|---|
| 2257247 | 8/1975 | France | 211/163 |

*Primary Examiner*—Robert W. Gibson, Jr.

*Attorney, Agent, or Firm*—Keith S. Bergman

[57] ABSTRACT

A vertically oriented, peripherally defined, and rotatably mounted column defines a plurality of spaced sets of similar spaced holes to receive and support the shanks of elongate fasteners. The column carries, between sets of spaced holes, a plurality of "L" shaped brackets, each having upturned support arms spaced radially outward from the column to receive and support a plurality of annular washers or nuts thereon. The column is rotatably mounted on a bracket for support on either horizontal or vertical surfaces. The column supports fasteners for sorting, display, and storage and may be used as a merchandising container for such products. A second species provides a plurality of cylinders that are rotatably supported in spaced circular array on a medial stand that provides additional means for storage of a stock of fastening devices. A third species provides a column formed with a polygonal cross-section by a plurality of planar panels removably carried in a supporting frame so that the panels may be individually placed and removed while carrying fasteners.

12 Claims, 4 Drawing Sheets 10
12
34
35
43
14
20
19
40
16
16
44
13
18
31
11
33
41
42
32
42
41
42
15
16
16

HOLDER FOR SCREWS, BOLTS, NUTS AND WASHERS

BACKGROUND OF INVENTION

1. Related Applications

There are no applications related hereto heretofore filed by the instant inventors in this or any foreign country.

2. Field of Invention

Our invention relates generally to storage devices, and more particularly to rotatably mounted peripherally defined columns having holes for support of elongate fasteners and carry brackets with upstanding vertical arms for support of annular fasteners.

3. Background and Description of Prior Art

The sorting, storage and maintenance of screws, nuts, bolts, washers and similar fasteners in smaller amounts than those customarily packaged for bulk sales has presented a perennial problem. The problem is exacerbated by the large number of different sizes and types of such items, and the fact that the ordinary user normally does not desire large quantities of a particular item, but does desire a substantial number of different items that vary in size, threading, head type, length and the like. Responsively, various holders have become known to fulfill this need, but none have completely done so. The instant invention provides a new, novel and improved member of this class of device.

To be effective for fastener storage a holder must not only provide means for positionally maintaining fasteners, but also must maintain similar fasteners in groups that are readily accessible for selection of individual items. Most known holders have merely provided bin-type containers wherein a plurality of fasteners are stored in a loose, bulk fashion without positional maintenance of individual elements or segregation of different elements relative to each other. Bin type storage, though relatively inexpensive and simple of construction, creates a problem in allowing various contained fasteners, and especially externally threaded portions of bolts and screws, to contact each other often with substantial impact under ordinary conditions of use. As this occurs, the relatively delicate threaded structures may be damaged to make the fasteners unusable or ineffective if used. Our holder solves this problem by providing individual holes for containment and support of each elongate fastener in a fashion which prevents the fasteners from impinging upon and contacting each other under even relatively violent handling conditions.

Individual support holes for elongate fastener storage have an added benefit in that they may be sized for particular diameters of fastener shanks and by reason of this feature, the holes serve as a means for aiding automatic sorting of elongate fasteners by reason of their diameter. Support brackets that carry annular washers or nuts may serve a similar purpose by providing vertical storage elements that are of substantially the same diameter as a fastener holes to allow sorting based on fastener. The sizing of holes or bracket elements substantially the same as the corresponding dimensions of fasteners being held provides a secondary advantage by creating some security of holding fasteners so that they may not be readily removed from their associated holding element by accidental impact forces or motions not intended to cause their release.

Fastener holders to be effective must provide storage for a substantial number of relatively small groups of elongate fasteners and fewer groups of annular elements, as the same annular elements may be used upon bolts of similar diameter and thread but with other differing characteristics. We accomplish this end by providing a peripherally defined columnar storage element with groups of lineally arrayed, spaced holes oriented in an axially parallel fashion with brackets for nut and washer support positioned between groups of holes. The columnar storage surface provides a secondary benefit in allowing simple and compact rotary mounting of the storage column, so that the column may be rotated to allow ready selection of and access to stored fasteners while yet providing a large storage area that occupies a relatively small space.

Our holder also may be used at various periods of the life cycle of the elements stored. Though it is primarily designed for use as a storage device for an end user of stored products, it may also serve as a container for transport and merchandising. The peripherally defined, columnar structure of the device serves this latter purpose admirably as the structure is relatively low in mass, strong and durable and may have stored objects maintained within its structure by means of sheet plastic "shrink wrap" or the like carried about its external periphery for periods of transportation, storage or other uses which could untimely disorient the stored elements or cause or allow their removal from the device. A species of holder providing plural removable panels also allows such use as related to an individual panel which comprises only a part of the entire holding device.

Our invention resides not in any one these features per se, but rather in the synergistic combination of all of the structures of our holder that necessarily give rise to the functions flowing therefrom, as herein specified and claimed.

SUMMARY OF INVENTION

Our invention provides a fastener holder with a peripherally defined, closed end column supported in vertical orientation for rotary motion relative to its support structure. The vertical surface of the column defines a plurality of groups of lineally arrayed, spaced holes for the releasable support of fastener shanks extending therethrough, with holes of each group having similar size and the holes of different groups having different sizes. The column carries a plurality of "L" shaped fastener support brackets arrayed between hole groups and providing vertical support arms at a spaced distance outwardly adjacent the column periphery to releasably carry washers and nuts. A mounting bracket provides support for the holder on either a vertical or horizontal surfaces. A first species of holder provides spoke-like arms carried by a medial support shaft, each arm supporting a fastener holder in its end part. A second species of holder provides a plurality of planar panels removably carried in a frame to define a column with polygonal cross-section that allows placement and removal of individual panels while carrying fasteners.

In creating such a fastener holder, it is:

A principal object to provide a rotatable, peripherally defined columnar holder to support a plurality of groups of similar screws, bolts, nuts and washers on its periphery, with similar members of a group being identifiable by their positional array.

A further object is to provide such a holder wherein bolt and screw holes are of substantially the same size as the supported portion of the fastener to be carried therein to allow the hole size to aid in classifying such fasteners of different sizes.

A still further object is to provide such a holder that aids in positionally maintaining stored fastener elements against accidental external forces that tend to dislodge them, yet allows ready removal of fasteners upon appropriate manual manipulation.

A still further object is to provide such a holder that is rotatably mounted to allow ready selection of any stored fasteners and yet provide a large storage area with a small volume.

A still further object is to provide such a holder that maintains elongate fasteners in spaced array so that such fasteners cannot contact each other, especially by reason of accidental external forces, to damage their external threads.

A still further object is to provide such a holder that may be rotatably supported on a horizontal or vertical surface, or supported in groups on a free standing support which provides bulk storage for additional fasteners.

A still further object is to provide such a support that may be formed as a column with polygonal cross-section to provide a plurality of surface panels that may be individually placed and removed while carrying fasteners.

A still further object is to provide such a holder that is of new and novel design, of rugged and durable nature, of simple and economic manufacture and otherwise well suited to the uses and purposes for which it is intended.

Other and further objects of our invention will appear from the following specification and accompanying drawings which form a part hereof. In carrying out the objects of our invention, however, it is to be understood that its essential features are susceptible of change in design and structural arrangement, with only one preferred and practical embodiment being illustrated in the accompanying drawings as is required.

BRIEF DESCRIPTION OF DRAWINGS

In the accompanying drawings which form a part hereof and wherein like numbers of reference refer to similar parts throughout.

DESCRIPTION OF THE PREFERRED EMBODIMENT

Figure 1:
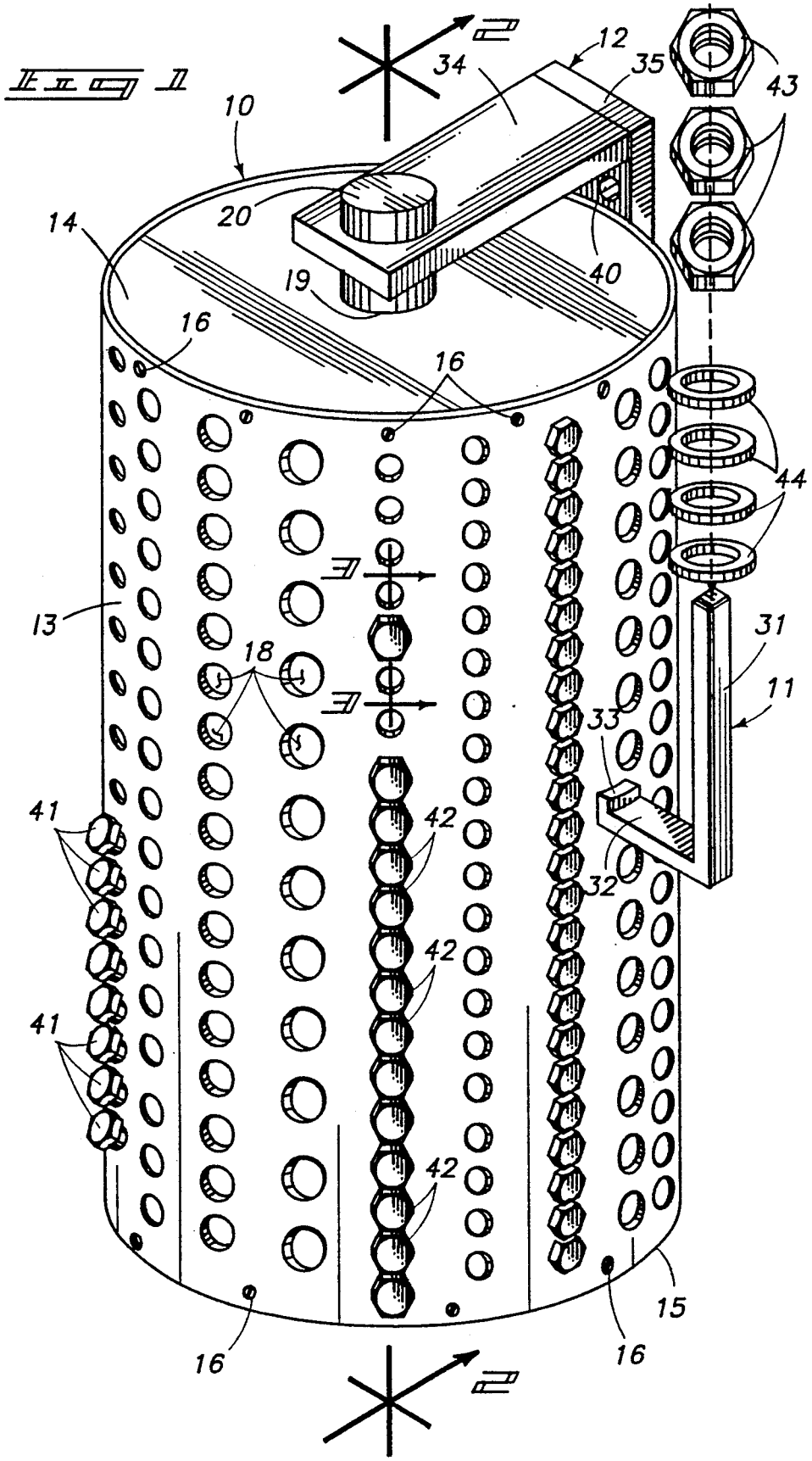
FIG. 1 is an isometric surface view of a first species of our fastener holder, providing a single fastener holding cylinder, showing its various parts, their configuration and relationship, with some fasteners in stored position thereon.

Our invention in its first primary species generally provides a holder with columnar body 10 journaled in mounting bracket 12 for support carrying nut and washer support brackets 11. A second species provides a plurality of holders carried by free standing standard 50. A third species provides a holder column 73 of prismoidal shape with releasably positionable side panels defining its peripheral surface.

In the first species of our invention, columnar body 10 provides a peripherally defined cylinder formed by relatively thin vertical side 13 and structurally interconnected upper end 14 and lower end 15. The ends are mechanically interconnected to the respective end portions of the vertical side, in the instance illustrated by screw-type fasteners 16 extending through holes 17 defined in the side inwardly adjacent its upper and lower edges and into threaded engagement in the circumferential portion of the ends. This joinder may be accomplished by other appropriate fastening means, such as adhesion, welding or the like depending upon the materials involved. Both the ends and side of the cylindrical column are formed of some reasonably rigid durable material of appropriate strength to support the loads placed upon these structures. The material of preference for the side element is relatively thin sheet metal or sheet plastic and for the ends somewhat thicker wood, metal or plastic.

Side 13 defines a plurality of fastener holes 18 extending therethrough to support the shanks of bolts or screws. These fastener holes 18 are of circular configuration and sized slightly larger by a few thousands of an inch than the external diameter of a fastener shank to be supported. The holes are spacedly arrayed relatively to each other in positionally related groups of similarly sized holes. Each hole of a group is spaced from other holes of that group and each group is spaced from adjacent groups to allow fasteners to be placed in supporting holes without the heads of adjacent fasteners interfering with each other. The spacing of holes should not be much greater than required to allow as large a number of fastener holes as reasonably possible in the side.

Preferably groups of fastener holes of similar size are arrayed in vertical linear alignment, as illustrated, with the alignment axis being substantially parallel to the axis of the column defining the holes. This array of groups of holes provides a simple and easy arrangement for distinguishing one group of holes from another and also allows a reasonably dense pattern of holes with appropriate spacing to accommodate nut and washer brackets between hole groups. The particular specified array of holes, however, is not essential to our invention, and it is possible that groups of fastener holes might be arrayed in spirals, in horizontal rings or otherwise and yet remain within the ambit of our invention. The fastener holes are defined so that their axes are perpendicular to the axis of cylindrical side 13 to allow easier fastener manipulation and aid positional maintenance of the fasteners.

Nut and washer brackets 11 are "L" shaped elements each having upstanding vertical support arm 31 and horizontal fastening arm 32 preferably with fastening flange 33 in its inner column contacting end part. The cross-sectional size of support arm 31 must be such as to allow placement of annular washers and nuts thereover for support. The cross-sectional shape of the support arm is not critical, but more secure and better support and less damaging contact is provided by a circular cross-sectional shape than one of other geometry. If the largest diametrical dimension of a cross-section of the support arm is only slightly less than the diameter of the orifice in annular elements to be supported thereon, the supported elements will not move appreciably on the support and if they do move, those elements will not have so much impact as with a diametrically smaller support. Such configuration and dimensioning is therefore beneficial and preferred to prevent damage to the supported elements, and especially to the internal threads of nuts. The length or vertical extent of support arm 31 is not critical and is determined to allow the arm to support as many nuts or washers of a particular type as may be desired.

Fastening arm 32 must have sufficient length to space nuts and bolts carried by the associated support arm 31 at an appropriate distance outwardly from the peripheral surface of side 13, so that those fasteners may be placed on a support arm in a substantially horizontal orientation without interference from either side 13 or the heads of elongate fasteners stored in the holder. The cross-sectional shape of the fastening arm is not critical, but commonly for ease of manufacture will be the same as that of the support arm. Fastening flange 33 is not essential to our invention, but is convenient to provide additional surface to aid mechanical fastening of the inner portion of the support arm to the outer peripheral surface of side 13.

A plurality of nut and bolt brackets are arrayed on the outer peripheral surface of cylindrical side 13, with the fastening arms 32 structurally interconnected with side 13 between linear arrays of holes 18. Brackets 11 are vertically spaced relative to each other so that an upper bracket will not interfere with a lower bracket when annular fasteners are placed or removed. The total number of support brackets generally will be less than the number of groups of bolt holes, as commonly the same nuts and washers may be used on several groups of bolts of similar diameter which have lengths or other characteristics. For ease of illustration, only a limited number of support brackets have been shown in the drawings, but it should be understood that the number illustrated is not limiting and any number of such brackets arrayed about the columnar body is within the scope of our invention.

Written indicia indicating the identity of particular types of bolts or screws to be associated with groups of holes and support brackets if desired. Such identifying indicia are within the scope of our invention, though they are not necessary or required for its function and are not illustrated.

In the primary species of our invention, upper end 14 defines medial hole 19 to receive upper jack axle 20 and lower end 15 defines hole 21 to receive lower jack axle 22. The upper jack axle 20 provides fastening flange 24 to interconnect with the inner surface of upper end 14 spacedly adjacent the periphery of hole 19 with the axle body extending outwardly through that hole and a spaced distance therebeyond. Fastening flange 24 is fastened to the inner surface of the upper end, in the instance illustrated, by screws 25 extending through holes defined in the flange and into threaded engagement with the upper end. This particular fastening is not essential and may be accomplished by riveting, bolting, adhering or the like. Lower jack axle 22 provides fastening flange 27 which fits inwardly adjacent the inner surface of lower end 15 where it is fastened by screws 28. The body of the lower jack axle extends through hole 21 and a spaced distance outwardly therefrom to allow mounting of that axle in a support structure. The outer end portion 29 of lower jack axle 22 is diametrically smaller than the axle body to define shoulder 30 which acts as a thrust bearing when the axle is mounted in a support structure.

Both jack axles are arrayed in alignment with each other and with column 10 to allow rotation of the column thereabout. The jack axle structure illustrated is not essential and may comprise a solid axle structure extending completely through the cylinder body. This general type of rotatable mounting structure and the nature of supports required by it are well within the ambit of knowledge of an ordinary mechanic.

Mounting bracket 12 is a rigid "U" shaped structure formed by structurally interconnected upper horizontal arm 34, vertical back 35 and lower horizontal arm 36 configured to allow rotation of column 10 relative to the bracket when the column is supporting fasteners. Upper horizontal arm 34 defines hole 37 to journal upper jack axle 20 and lower horizontal arm 36 defines hole 38 to journal smaller end portion 29 of lower jack axle 22, with shoulder 30 bearing on the upper surface of the lower horizontal arm 36 to serve as a thrust bearing. The length of portion 29 of the lower jack axle is not greater than the thickness of the lower horizontal arm so that the lower horizontal arm may be used as a base for support of the holder structure on a horizontal surface. Bearing 39 is structurally carried on the upper surface of lower horizontal arm 36 to journably support the body of the lower jack axle 22 to provide a stronger and more rigid structure than would result were only the smaller portion 29 of that axle journaled in the lower horizontal arm. Vertical back 35 defines a plurality of vertically spaced fastener holes 40 to allow fastening of that arm on a vertical support.

The second species of our invention illustrated in FIGS. 4–7 provides a plurality of fastener holder columns carried in spaced circular array by a single vertical standard 50.

Holder column 51 of this second species is of the same nature as that element in the first species, though the overall size may be somewhat less in the second species. Fastener holes and brackets 11 are of the same nature and array as in the first species of holder column. Bottom 52 of column 51 is fastened to cylinder side 53 as in the first species, but is of solid construction and does not provide a jack axle shaft. Top 54 of the column defines medial, axially aligned hole 55 to allow passage of bearing shaft 56 upwardly therethrough. This bearing shaft defines medial cylindrical channel 57 and lower fastening flange 58 which is interconnected to the inner surface of upper end 54 by fasteners 59 extending operatively therebetween.

Standard 50 provides base 60 supporting vertically upstanding support shaft 61. The support shaft is of compound nature with a lower portion rotatably interconnecting an upper portion to allow that upper portion to rotate relative to the base 60. The uppermost end portion of shaft 61 defines medial channel 62 to receive fixture 63 which structurally carries support arms 64. The support arms 64 extend radially outwardly from fixture 63 to define outer end portions 65 that depend vertically in angularly spaced circular array about support shaft 61. Though not illustrated, support shafts 61 may extend upwardly rather than downwardly from support arms 64. In this instance the support shafts would be carried in the medial channel of lower jack axles to support fastener holders in an upstanding fashion.

Figures 4, 5, 6, 7:
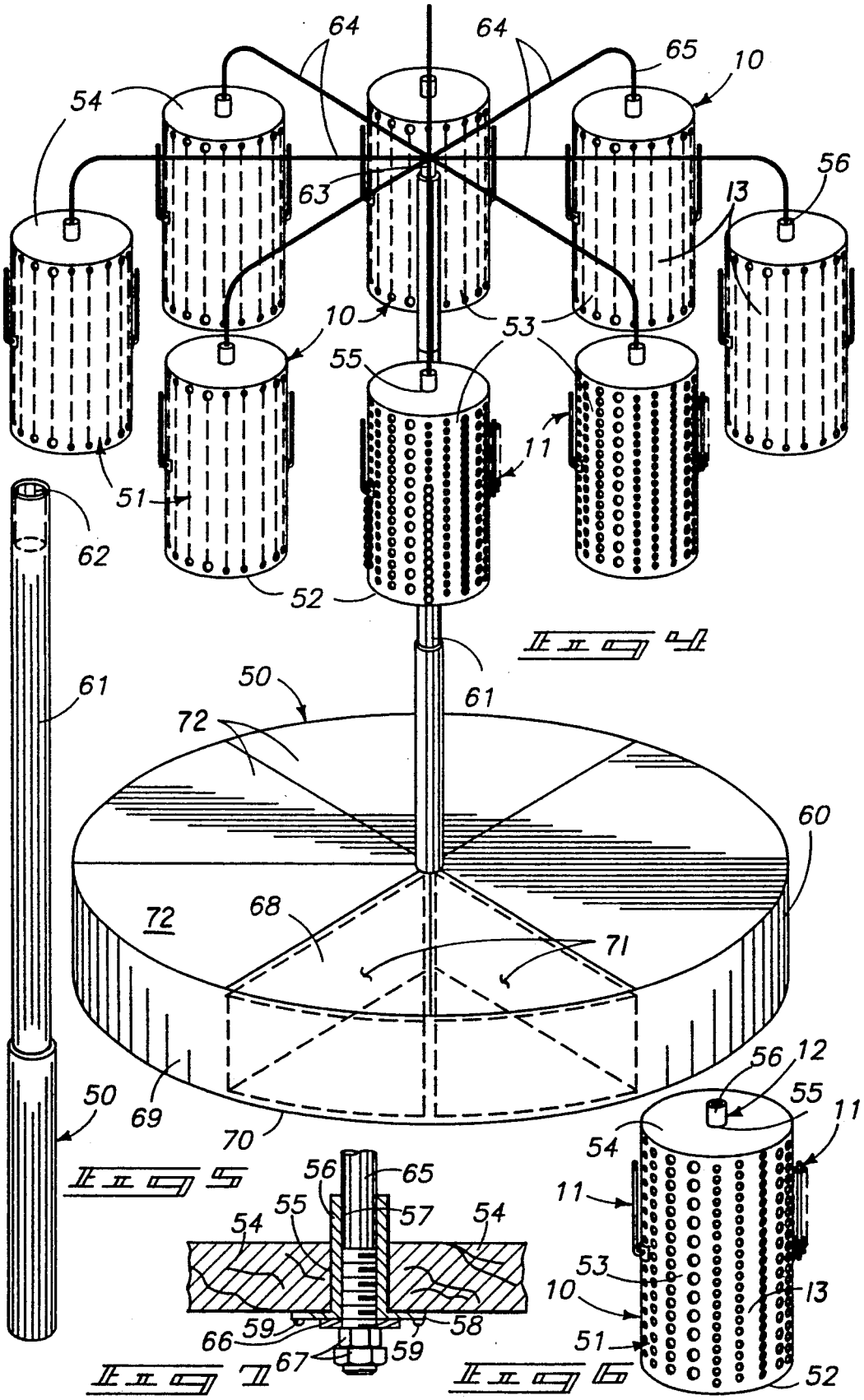
FIG. 4 is an isometric view of a second species of our invention having a self-supporting stand carrying a plurality of fastener holding columns.
FIG. 5 is an isometric view of the vertical support portion of the stand of FIG. 4 with some internal portions shown in dashed outline.
FIG. 6 is a somewhat enlarged isometric view of one of the fastener holding columns of FIG. 4.
FIG. 7 is an enlarged, partially cut-away cross-sectional view showing the attachment of a fastener holding column of FIG. 4 to the arm supporting it.

As seen especially in FIG. 7, the lowermost part of end portion 65 of each support arm is threaded and of a size to rotatably fit within channel 57 of bearing shaft 56 and depend somewhat therebelow. Each holder column is releasably maintained on its associated support arm 64 by washer 66 and locked nuts 67 engaged on the threaded end portion 65 of the support arm below bearing shaft 56. With this structure, each depending holder column may be rotated upon portion 65 of the associated support arm 64 to aid user access to fasteners supported thereby.

Standard 50 preferably provides a support shaft of such length as to portion supported fastener holders at a convenient height above a floor for use, usually between the waist and shoulders of a standing user. The base 60 of the standard must be large and massive enough to serve its support purpose and this allows it to be used as a convenient storage place for bulk fasteners. In the instance shown in FIG. 4, the base is formed as a cylindrical disk with an angle iron framework 68 supporting cylindrical side 69 and interconnected bottom 70. The inner portion of the disk is divided into a plurality of pie-shaped chambers 71 covered by plural removable covers 72. These chambers provide storage space for bulk fasteners and those stored fasteners provide additional mass to aid in stabilizing the base on a supporting surface.

Figure 8:
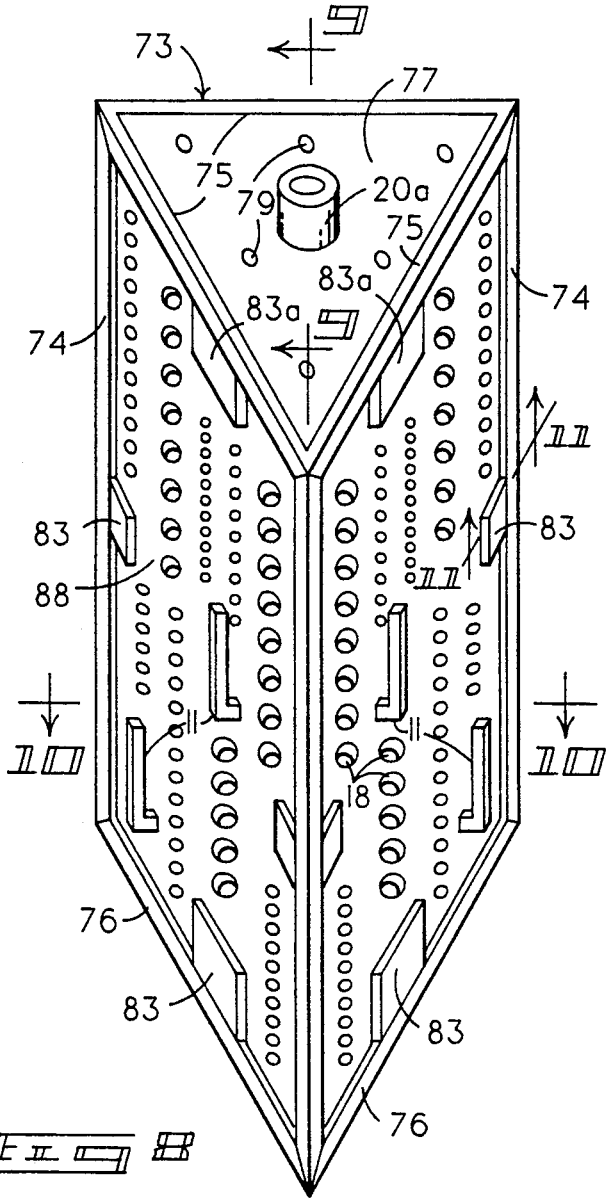
FIG. 8 is an isometric surface view of a third species of our holder having a column with triangular cross-sectional configuration and removable panels.
Figure 9:
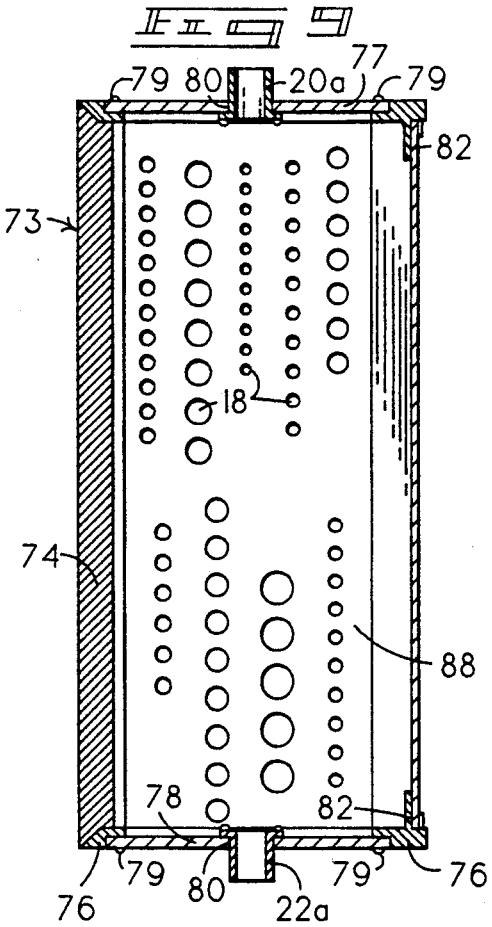
FIG. 9 is a vertical cross-sectional view through the column of FIG. 8, taken on the line 9—9 thereon in the direction indicated by the arrows.
Figure 10:
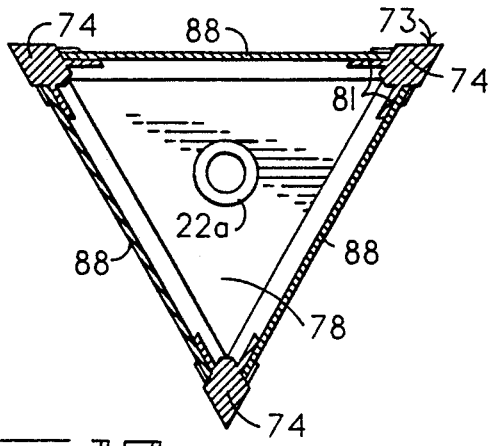
FIG. 10 is a horizontal cross-sectional view through the column of FIG. 8, taken on the line 10—10 thereon in the direction indicated by the arrows.

A third species of our invention provides a holder column 73 that is of a polygonal cross-sectional shape peripherally defined by planar panels that allow placement and removal of individual panels. The column 73 illustrated in FIGS. 8, et seq., is of a three-sided cross-sectional configuration, but it is to be understood that columns with polygonal cross-sections having sides greater in number than three are within the scope of our invention.

Column 73 is formed with a rigid peripheral frame having similar vertical edges 74 and similar top edges 75 and bottom edges 76 all structurally interconnected in their adjacent end portions. The top and bottom surfaces of the frame are parallel and each define similar inset areas to receive planar top element 77 and bottom element 78 of appropriate thickness to form a coplanar surface with the top and bottom frame portions. The top and bottom elements are fastened to the frame elements by mechanical fasteners 79 appropriate for the materials involved, constituting screws in the instance illustrated. The top and bottom elements each define holes 80 for mounting jack axles 20 and 22 respectively. These holes are axially aligned with the axis of symmetry of the holder column to facilitate rotation. The mounting structure illustrated is the same as for the first species of our invention, though the jack shafts of this third species of our invention define medial channels so that they may be mounted as the second species if desired.

Each flat side defining a vertical surface of the polygonal column 73 provides a rectilinear panel insert cooperatively defined by grooves 81 in the opposed vertical frame elements and grooves 82 in the horizontal top and bottom elements. The depth of these grooves 81, 82, that is their dimension perpendicular to the columnar axis, is substantially the same as the thickness of panels to be supported to allow placement of panel fasteners to releasably maintain and fastenably support panels in the panel inserts.

Figure 11:
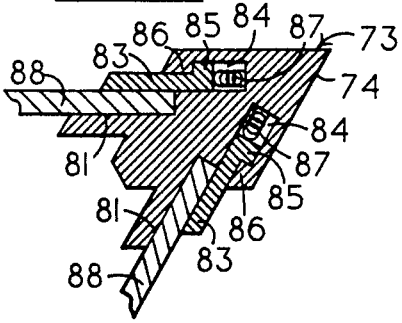
FIG. 11 is a somewhat enlarged cross-sectional view through a movable panel fastening device of FIG. 8, taken on the line 8—8 thereon in the direction indicated by the arrows thereon.

A movable type of panel fastener is shown in FIG. 11 where it is seen to comprise fastener 83 slidably carried in channel 84 defined in a frame edge defining a panel inset. The fastener 83 provides a perpendicularly extending retaining lug 85 to retain the inner portion of the fastener in channel 84. The channel is of sufficient size to allow the slidable motion of fastener 83 and lug 85, but provides inwardly projecting ledge 86 immediately inwardly of its orifice to prevent the passage of retaining lug 85 therepast to maintain the inner portion of fastener 83 in the fastener channel 84. One or more compression springs 87 carried in channel 84 extend into outwardly biasing contact with the inner surface of fastener 83. The channel 84 is defined in a position spacedly outward from the inner surface of grooves 81, 82 so that a panel may fit in the space between the groove and an associated panel fastener. With this structure a panel fastener will be biased to an extended panel fastening position, but will be manually movable against its bias into channel 84 to allow placement and removal of panels within the panel inset.

Figure 12:
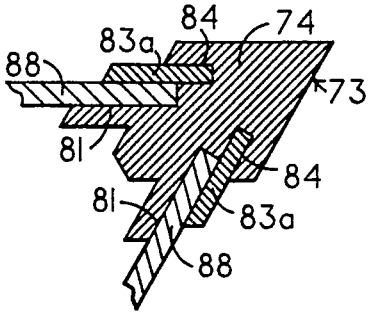
FIG. 12 is a somewhat enlarged cross-sectional view through an immovable panel fastening device taken on the line similar to that of FIG. 11.

It is to be noted that movable panel fasteners are required on only two contiguous sides of a panel inset to allow panel removal and an immovable fastener as shown in FIG. 12 may be used on two frame sides. Here the channel 84 is the same size as fastener **83*a* and both are sized to allow the fastener to project a spaced distance from the panel inset to allow fastening of a panel in the same fashion as with the movable fastener. The immovable fastener 83*a* is positionally maintained in channel 84** by mechanical fastening such as frictional engagement or adhesion.

Fastener holding panel 88 is a flat sheet of rigid material of a peripheral configuration to fit in the inset defined by grooves 81, 82 of the column frame and of a thickness to fit between associated fasteners 83 and the inner surface of the frame inset. The panel 88 defines groups of fastener holes 18 and provides annular fastener brackets 11 that are of the same nature and arrayed in the same fashion as in the first species of our invention to hold fasteners in the same fashion.

Having described the structure of our invention, its operation may be understood.

A fastener column is constructed according to the foregoing specification and supported for use upon an appropriate surface. The free-standing second species of our invention merely has to be assembled and is then self-supporting and ready for use when positioned on a horizontal supporting surface such as a floor.

For support of the first or third species on a vertical surface, fasteners are inserted through holes 40 in vertical arm 35 of the mounting bracket and into fastening engagement with a vertical structure adjacent to that arm, commonly a structural wall surface. For support on a horizontal surface, the column is positioned on that surface and its weight generally is sufficient to positionally maintain it for use. If desired, mechanical fasteners (not shown) might be inserted through appropriate holes defined in the lower bracket arm and into fastening engagement with a surface supporting the holder.

Figure 3:
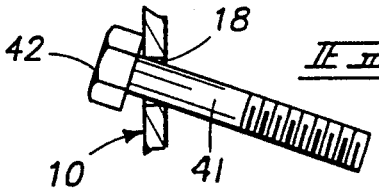
FIG. 3 is an enlarged partial vertical cross-sectional view through a hole supporting a bolt, taken the line 3—3 of FIG. 1 in the direction indicated by the arrows thereon, to show the nature of bolt support.
Figure 2:
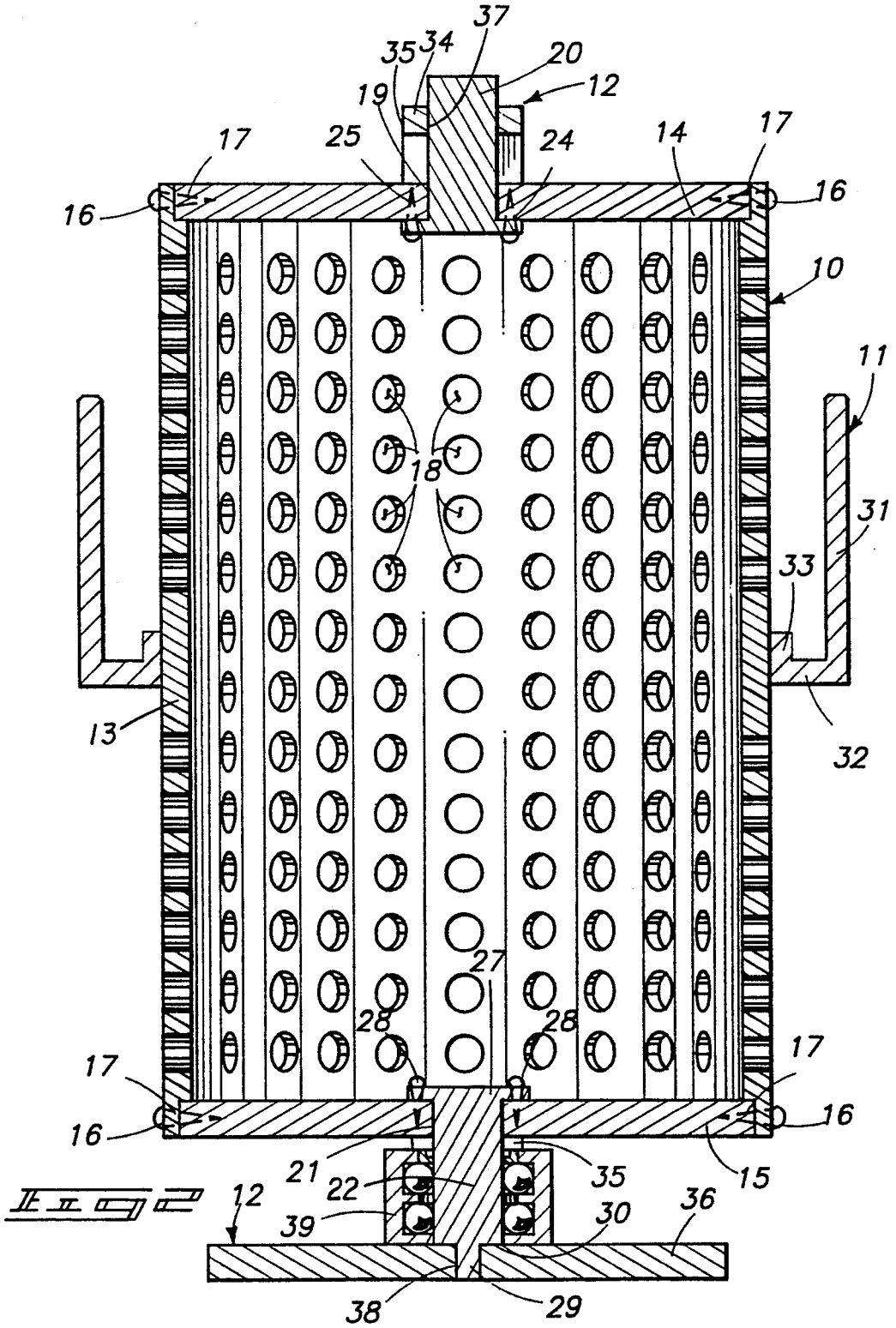
FIG. 2 is a medial vertical cross-sectional view through the holder of FIG. 1, taken on the line 2—2 thereon in the direction indicated by the arrows, to show further internal structure.

Once positionally established, any species of our fastener holder is ready for use in similar fashion. Bolts 41 having heads 42 are inserted into the appropriate group of bolt holes 18 configured for the storage of the particular bolt. As a bolt is inserted into a hole which is to support it, the portion of the shank inwardly of column side 13 tends to move downwardly by action of gravity and the nature of its cantilevered type of support as shown in FIG. 3. As this occurs, the shaft of the bolt adjacent the head becomes skewed in the hole 18 supporting it and is mechanically restrained by such action and the hole size from moving further downward in an angulated fashion. The nature of this skewing is determined by the thickness of cylinder side 13 and the relationship between the size of a supporting hole and the size of a bolt shaft being supported. Commonly this dimensional difference should not be more than a few thousandths of an inch. The skewing action is advantageous in preventing bolt shafts inwardly of column side 13 from coming into contact with each other and in tending to continue positional maintenance of bolts once established, as the holding forces will tend to prevent a bolt from accidentally moving outwardly from the hole supporting it. The reaction is substantially the same for positional maintenance of a screw as for a bolt.

It should be noted that though this skewing action is described as being caused by gravity in a vertical dimension, it also occurs more or less in a horizontal dimension so as to aid in preventing fasteners that are horizontally adjacent each other from coming into contact if our holder is subjected to horizontally directed forces. It should further be noted that the insertion of bolts into holes of a fairly similar size is aided by the bolt construction itself, as bolts normally do not have thread structure of any greater diameter than their shank structure and many bolts have an axially inwardly tapering portion or chamber at their end opposite the head which tends to aid insertion of a bolt shank into a holding hole. Screw shanks are sufficiently tapered that insertion into carrying holes generally presents no problem.

Nuts 43 and washers 44 are placed on support arms 31 of the support brackets by appropriate manual manipulation that places the orifices defined in such articles over the support arm and moves them downwardly on the support arm. After placement, either nuts or washers will be positionally maintained by gravity on the support brackets. It should be noted that these annular elements will also have somewhat of a skewing action on the support arm that is supporting them, if the size of that support arm be only slightly less than the size of the orifices defined in the nuts or bolts. The inner edge of the lowermost annular object will be supported on the upper surface of fastening arm 32, while the outer edge will not be supported and will move downwardly to cause canting relative to the support arm. Preferably the support arms are not more than a few thousandths of an inch smaller than the orifice defined in nuts or washers to be supported thereon, so that the annular elements will be supported by reason of their canted orientation relative to the support arm. This again will tend to prevent supported articles from accidentally moving relative to each other and to a support arm and from becoming accidentally dislodged from their support arms.

The initial loading of our fastener holder may be used as a sorting process to aid in classifying mixed nuts, bolts and washers into groups of similar size and type. The bolt holes 18 or support arms 31 serve admirably as measuring devices for this purpose because, by reason of their size, they will indicate whether a fastener is of the appropriate size or of different size from that class. After the holder has been loaded with fasteners, columnar body 10 may be rotated to provide access to and inspection of any of the fasteners supported by the column.

It should be noted that our holder also may be used for holding nuts, bolts and washers during transportation and for merchandising. The column provides a peripheral configuration of such nature that it may readily be encased in some material such as shrinkable plastic sheet, and if this material is placed about the outer periphery of the loaded column, the material will positionally maintain stored articles against dislodgement, whatever orientation the device may assume prior to removal of the plastic wrap. This feature is particularly advantageous with the third species of our holder as individual panels may be dealt with in this fashion for merchandising or otherwise.

The foregoing description of our invention is necessarily of a detailed nature so that a specific embodiment of it might be set forth as required, but it is to be understood that various modifications of detail, rearrangement and multiplication of parts may be resorted to without departing from its spirit, essence or scope.

Having thusly described our invention, what we desire to protect by Letters Patent, and

What we claim is:

1. A columnar holder for groups of similar elongate bolt and screw fasteners and annular nut and washer fasteners, comprising in combination, a peripherally defined columnar body having at least one relatively thin sheet-like vertical side interconnecting similar upper and lower ends with at least one end having means for rotatably mounting the column in substantially vertical orientation, said vertical side defining, spacedly arrayed groups of similar spaced holes, each group arrayed to aid identification of similar holes, each said hole being slightly larger than the diameter of a shaft of an elongate fastener to be carried therein so that the fastener is supported in an angulated orientation by the vertical side portion defining the hole periphery, and a plurality of support brackets carried by the body side in spaced array between the groups of spaced holes, each support bracket having a vertically orientated upstanding support arm spacedly outward of the vertical side to support a plurality of annular fastening elements.

2. The holder of claim 1 further characterized by:

the upper and lower ends of the columnar body carrying aligned axles projecting a spaced distance outwardly from each said end, the lower axle defining a body portion and a diametrically smaller end portion to create a thrust bearing and a mounting bracket having spaced upper and lower horizontal arms interconnected by a vertical back, said upper arm journaling the axle projecting from the upper end of the columnar body and said lower arm journaling the smaller portion of the axle projecting from the lower end of the columnar body below its shoulder, said vertical arm being spacedly outward from the columnar body to allow rotation of the columnar body relative to the mounting bracket when that body is supporting fasteners.

3. The holder of claim 1 further characterized by:

one end of the columnar body carrying an axially aligned support shaft extending a spaced distance outwardly from the end, said support shaft defining a channel to receive a support shaft for pivotally mounting the cylindrical body on the support shaft.

4. The holder of claim 1 further characterized by:

the columnar body configured as a prism formed with a peripheral frame defining the prism edges and a substantial part of each vertical prism side formed by a sheet-like panel releasably carried by the peripheral frame portion defining the edges of the prism side.

5. The holder of claim 4 further characterized by:

the peripheral frame portion defining the edges of each vertical prism side further defining an inset to receive a rigid, planar panel and said peripheral frame portion carrying a plurality of panel fasteners having fastening elements extending a spaced distance over the periphery of the planar panel to positionally maintain the panel within the inset, said fasteners carried by at least two adjacent frame edges being of a movable nature to allow panel placement and removal.

6. The holder of claim 1 wherein the fastener holes defined in the columnar body are larger than the diameter of elongate fasteners to be carried therein by an amount of less than about 0.05 inch to maintain an elongate fastener carried therein in an angulated relationship to the axis of the hole.

7. The holder of claim 1 wherein the largest diameter of the vertical arm of each support bracket is smaller than the diameter of a hole defined in annular fasteners to be supported thereon by an amount less than about 0.05 inch to maintain annular fasteners carried on the vertical arm in an angulated relationship to the vertical arm.

8. The holder of claim 7 wherein each support bracket is of "L" shape with a vertical support arm supported by a horizontal fastening arm structurally carried by the outer surface of the columnar body.

9. The holder of claim 1 further characterized by:

the groups of similar fastener holes spacedly array in linear orientation parallel to the axis of the columnar body and the support brackets spacedly arrayed between the linear arrays of fastener holes in a vertical spaced relationship so that an upper support bracket does not interfere with the placement and removal of annular fasteners from a support bracket therebelow.

10. A holder for plural groups of similar elongate screw and bolt fasteners and annular washer and nut fasteners comprising, in combination:

a peripherally defined columnar body having relatively thin rigid sheet-like vertical sides interconnecting an upper end and a similar lower end, each end carrying upper and lower axles projecting a spaced distance from each end for rotatable mounting, the lower axle defining a smaller end portion to create a thrust bearing, said columnar body defining spacedly arrayed groups of similar spaced, lineally arrayed fastener holes, each said hole having a diameter larger by less than about 0.05 inch than the diameter of the shaft of an elongate fastener to be carried therein so that the said fastener is supported in an angulated orientation by the hole periphery and said columnar body carrying a plurality of support brackets, each having a vertically upstanding support arm carried at a spaced distance outwardly from the columnar body to carry a plurality of annular fasteners, said support arm having a diameter smaller by less than about 0.05 inch than the diameter of the hole defined in annular fasteners to be carried thereon and said support brackets arrayed between groups of similar holes; and a mounting bracket having spaced horizontal upper and lower arms structurally interconnected by a vertical back, said upper arm journaling the upper axle and said lower arm journaling the lower column axle, said vertical arm being radially outward of the columnar body to allow rotation of the columnar body relative to the bracket when that body is supporting fasteners.

11. The holder of claim 10 further characterized by:

the columnar body comprising a prism having a cross-sectional configuration of a polygon defined by a peripheral frame forming the prism edges;

the vertical prism sides defined by the peripheral frame each defining an inset to receive a sheet-like panel and releasably maintain the panel in the inset by a plurality of panel fasteners carried by the frame and having fastening elements extending a spaced distance over the panel periphery, the panel fasteners on at least two adjacent frame edges being releasably movable to allow panel placement and removal.

12. A holder for plural groups of similar elongate screw and bolt fasteners and annular washer and nut fasteners comprising, in combination:

a free-standing standard having a base supporting an upstanding support shaft pivotally carrying, spacedly above the base, a plurality of radially extending and circumferentially spaced support arms, each support arm having a vertically depending support shaft in its radially outer portion to rotatably carry a fastener holder column depending therefrom and fastening means to releasably maintain a fastener holder column thereon, and a plurality of fastening columns each having a peripherally defined columnar body with at least one relatively thin rigid sheet-like vertical side interconnecting an upper end and a lower end, one said end carrying a support shaft defining a medial channel to rotatably receive the vertical support shaft of a support arm, said vertical side defining spacedly arrayed groups of similar spaced, lineally arrayed fastener holes, each said hole having a diameter larger by less than about 0.05 inch than the diameter of the shaft of an elongate fastener to be carried therein so that the fastener is supported in an angulated orientation by the hole periphery and said columnar body carrying a plurality of support brackets, each having a vertically upstanding support arm carried at a spaced distance outwardly from the columnar body to carry a plurality of annular fasteners, said support arm having a diameter smaller by less than about 0.05 inch than the diameter of the hole defined in annular fasteners to be carried thereon and said support brackets arrayed between groups of similar holes.

* * * * *